United States Patent [19]

Rolfe

[11] Patent Number: 5,068,839

[45] Date of Patent: Nov. 26, 1991

[54] RESETTABLE SANDGLASS-TYPE TIMING DEVICE WHICH PROVIDES SELECTIVE TIMING PERIODS

[75] Inventor: Gary Rolfe, Basingstoke, Great Britain

[73] Assignee: Neil Lawrence, Australia

[21] Appl. No.: 459,765

[22] PCT Filed: Jun. 30, 1988

[86] PCT No.: PCT/AU88/00226

§ 371 Date: Jan. 16, 1990

§ 102(e) Date: Jan. 16, 1990

[87] PCT Pub. No.: WO89/00721

PCT Pub. Date: Jan. 26, 1989

[30] Foreign Application Priority Data

Jul. 16, 1987 [GB] United Kingdom ..... 8716838
Dec. 31, 1987 [GB] United Kingdom ..... 8730361
May 5, 1988 [GB] United Kingdom ..... 8810548

[51] Int. Cl.[5] ..... G04F 1/04
[52] U.S. Cl. ..... 368/93
[58] Field of Search ..... 368/93–95

[56] References Cited

U.S. PATENT DOCUMENTS 4,527,905 7/1985 Kohls ..... 368/93
4,813,030 3/1989 Johnson ..... 368/93

FOREIGN PATENT DOCUMENTS 1494763 10/1939 Fed. Rep. of Germany .
7611709 11/1976 Fed. Rep. of Germany .
49288 2/1939 France .
1209552 3/1960 France ..... 368/93
479075 1/1938 United Kingdom ..... 368/93

*Primary Examiner*—Bernard Roskoski
*Attorney, Agent, or Firm*—Ostrolenk, Faber, Gerb & Soffen

[57] ABSTRACT

A sandglass-type timing device which can be reset to commence a new timing operation without first completing a pre-existing timing function. The timing device is formed from a transparent plastics material and it comprises a first chamber (18), a second chamber (19) and a narrow neck (20) interconnecting the two chambers. A particular material (21) is located within the device and it is flowable, under the influence of gravity, to pass from the first to the second chamber and vice versa by way of the neck (20). A passageway (24) interconnects the first and second chambers (18 and 19) and provides an unimpeded passage through which the material (21) can be directed, by appropriately orientating the device, as an alternative to trickling it through the neck (20).

4 Claims, 2 Drawing Sheets

RESETTABLE SANDGLASS-TYPE TIMING DEVICE WHICH PROVIDES SELECTIVE TIMING PERIODS

TECHNICAL FIELD

This invention relates to a timing device of a type that is generally referred to as a "sandglass" but one which can be reset to commence a new timing operation without first completing an existing timing operation.

BACKGROUND ART

The conventional sandglass timer comprises two closed chambers that are interconnected by a narrow neck, and sand or other particulate material is located within the timer in such a way that it may flow from one chamber to the other, under the influence of gravity, by way of the neck. The timer is usually formed from glass or a transparent plastics material and a predetermined period of time is deemed to have passed when the entire quantity of sand is seen to pass from one chamber to the other.

A problem with the conventional sandglass timer is that the entire quantity of sand must pass from one chamber to the other before the timer can be inverted to commence a new timing operation, and this can be rather irritating under some conditions. For example, if the timer is being used to time-out the period allowed for a move in a board game and one participating player completes the move well before the sand transfer from one chamber to the other has been completed, then the players must wait patiently until the operation has been concluded before play may recommence.

DISCLOSURE OF THE INVENTION

The present invention is directed to a timing device which avoids this problem. The device is formed at least in part from a transparent material and it comprises a first chamber, a second chamber, a narrow neck which interconnects the first and second chambers, and a flowable material located within the device and flowable under the influence of gravity from the first chamber to the second chamber by way of the neck. The device is characterised in that at least one passageway is provided to interconnect the first and second chambers and to provide an unimpeded passage through which the flowable material may be directed as an alternative to passing it through the neck.

The timer in accordance with the present invention may be used in the conventional way, in the sense that a normal timing operation may be effected by locating all of the flowable material in the first chamber and by allowing it to trickle through the neck to enter the second chamber, the timing operation being completed when all of the material has transferred from the first to the second chamber. However, if it is required that a timing operation be curtailed and a new operation be commenced, the device may be inverted and be turned in such a way that the material will move in an unimpeded fashion between the chambers by way of the passageway.

It is preferred that the device be formed with just one passageway and that the device be formed with side wall portions which are constituted entirely by a transparent material. Also, it is preferred that the device be constructed in a manner such that the flowable material may be caused to flow in either direction, from the first to the second chamber or from the second to the first chamber, depending on the orientation of the device.

The timing device may be formed from glass or such other transparent material as a clear plastics material. The flowable material may be in the form of a particulate material, such as sand or ballotini, or, in certain circumstances, it may be constituted by a viscous liquid.

The timing device may be formed adjacent the neck with at least one port which interconnects the first chamber and the passageway, whereby a portion of the flowable material will transfer from the first chamber to the passageway at the same time that it is flowing from the first to the second chamber. Thus, with this construction, the timing device provides for the selection of one of two possible timing periods, depending upon the orientation of the device.

The invention will be more fully understood from the following description of three embodiments of the timing device. The description is provided by way of example only and with reference to the accompanying drawings.

MODES FOR CARRYING OUT THE INVENTION

Figure 1:
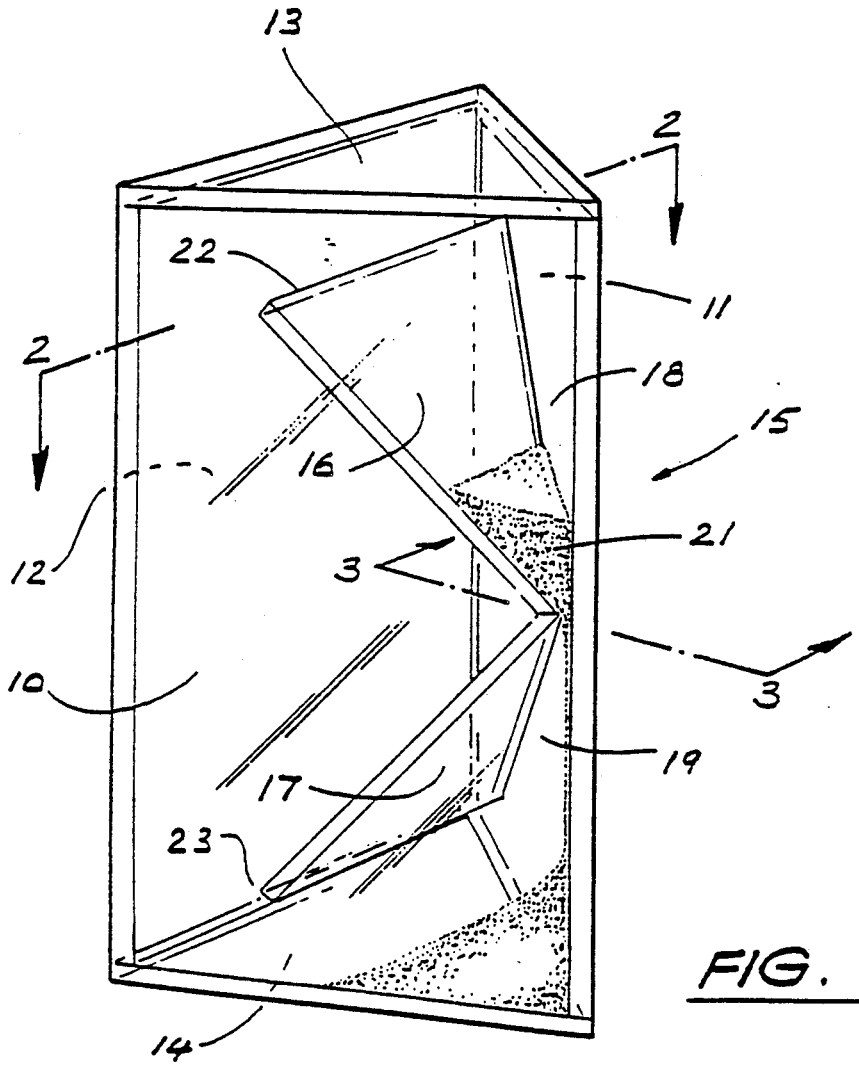
FIG. 1 shows a perspective view of a first form of the timing device.
Figure 2:
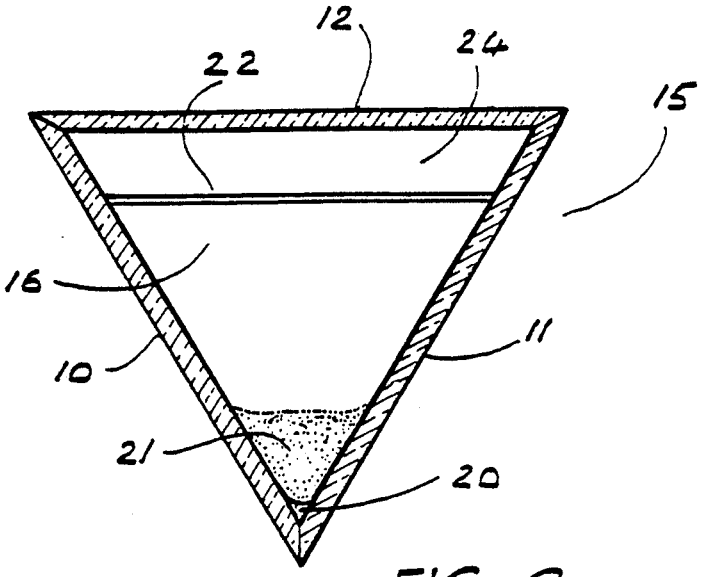
FIG. 2 shows a sectional Plan view of the device as seen in the direction of section plane 2-2 as indicated in FIG. 1.
Figure 3:
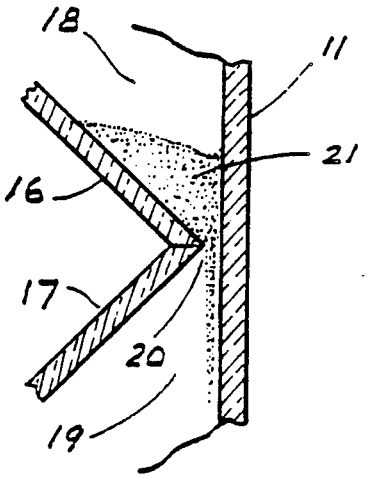
FIG. 3 shows a partial side elevation view of the device as seen in the direction of arrow 3 as also indicated in FIG. 1.

As illustrated in FIGS. 1 to 3, the timing device has three vertically extending side walls 10, 11 and 12 which connect together at their marginal edges to define a generally hollow triangular prism. The walls and other structural portions of the timer are moulded or otherwise formed from a clear plastics material such as polycarbonate or polystyrene.

Flat triangular-shaped end caps 13 and 14 are secured to the marginal ends of the side walls 10 to 12 to form an hermetically sealed casing 15. The end caps 13 and 14 may be secured to the ends of the side walls by gluing or welding.

Two triangular-shaped partitions 16 and 17 are located within the casing 15 and interconnect the two side walls 10 and 11. The partitions 16 and 17 co-operate with the relevant portions of the side walls 10 and 11 to form or define first and second chambers 18 and 19.

As best seen from FIG. 3 of the drawings, the partitions 16 and 17 do not project all the way into the apex of the two walls 10 and 11. Rather, a small gap or neck 20 is provided within and adjacent the apex so that a particulate material 21, which is located within the device, may flow through the neck 20 and transfer from the first chamber 18 to the second chamber 19 and vice versa.

The partitions 16 and 17 do not extend all the way out to the side wall 12, there being a gap between marginal edges 22 and 23 of the partitions and the side wall 12.

The partitions 16 and 17 co-operace with the side wall 12 to define a passageway or third chamber 24 which extends around the marginal edges 22 and 23 of the partitions to interconnect the first and second chambers 18 and 19.

When the device is required to perform a normal timing operation, all of the particulate material 21, which may be composed of ballotini, is located in one of the first or second chambers 18 or 19 and is allowed to trickle through the neck 20 to enter the other chamber, the timing operation being completed when all of the material has transferred from one chamber to the other. However, if it is desired to transfer the material 21 between two chambers more quickly than it will flow through the neck 20, the timing device may be inverted and be orientated such that the material will be induced to flow from the first to the second chamber by way of the third chamber 24.

Figure 4:
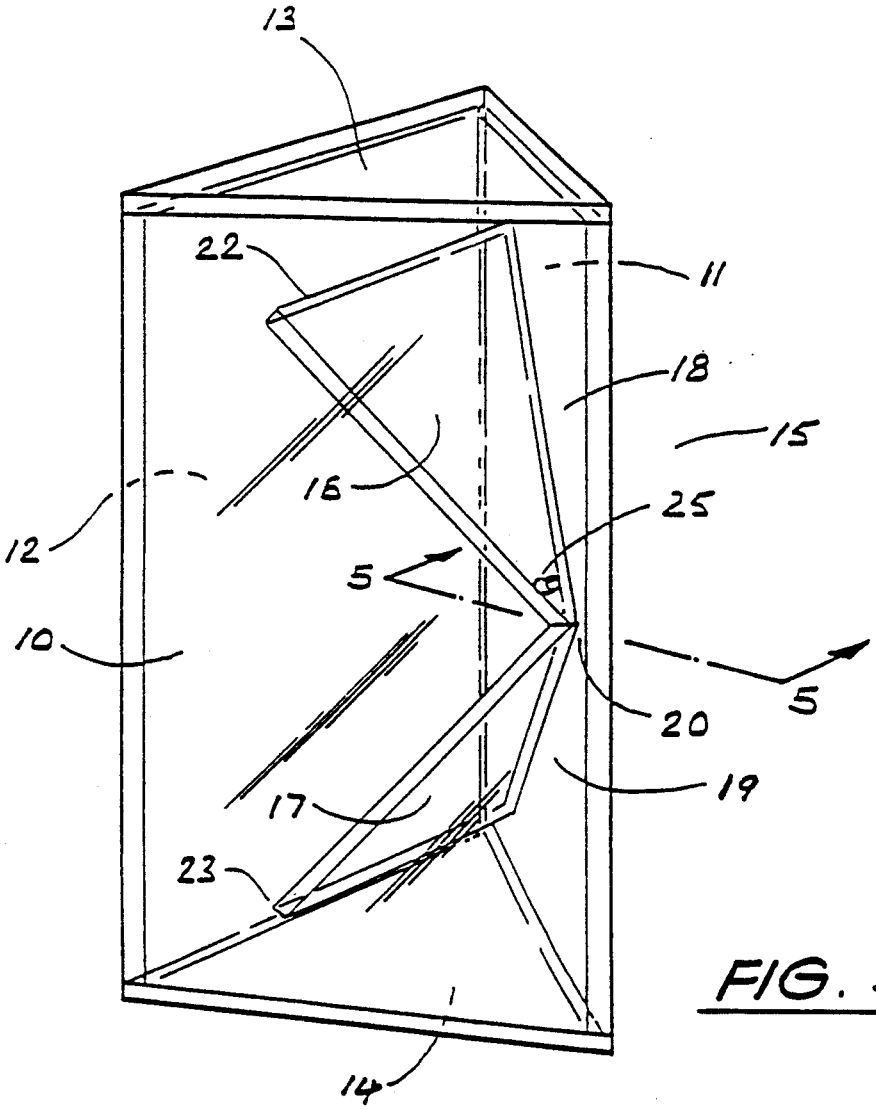
FIG. 4 shows a perspective view of a second embodiment of the timing device.
Figure 5:
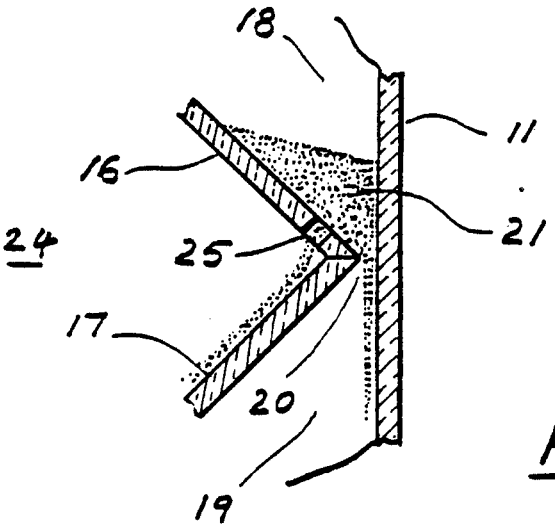
FIG. 5 shows a partial side elevation view of the second embodiment of the device as seen in the direction of arrow 5 as indicated in FIG. 4.

The timing device which is illustrated in FIGS. 4 and 5 is similar to that which is shown in FIGS. 1 to 3 and the same reference numerals are used to identify corresponding parts. However, the device as shown in FIGS. 4 and 5 provides for two (alternative) timing periods, depending upon the orientation cf the device.

In this case, a small port or aperture 25 is formed in the partition 16 adjacent the neck 20. The port 25 provides a communication between the first chamber 18 and the third chamber 24.

When the timing device is orientated in such a way that the particulate material 21 flows form the first chamber 18 to the second chamber 19, the material will also pass through the port 25 and flow down the face of the partition 17 that confronts the third chamber and the material will deposit on the end cap 14 at the bottom of the casing 15. Thus, the port 25 provides for the particulate material to flow from the first chamber 18 at a greater rate than it would flow from the second chamber 19 and, by making the cross-sectional area of the port 25 the same as that of the neck 20, the rate of transfer of the particulate material 21 from the first chamber will be double the rate at which the material is transferred from the second chamber when the device is inverted.

What is claimed is:

1. A timing device which comprises a casing in the form of a hollow prism which is formed at least in part from a transparent material, two partitions located within the casing and co-operating with wall portions of the casing to form first and second chambers which converge in a direction toward one another, a passageway interconnecting divergent ends of the chambers, a narrow neck interconnecting convergent ends of the two chambers, and a flowable material located within the device and moveable under the influence of gravity from one chamber or the other by way of the neck or, as an alternative to passing through the neck, in an unimpeded manner by way of the passageway, one of the partitions having a port therein located adjacent the neck, the port interconnecting the first chamber and the passageway such that a portion of the flowable material will transfer from the first chamber to the passageway at the same time that the material is flowing from the first to the second chamber.

2. The timing device as claimed in claim 1 wherein the casing comprising a hollow triangular prism and each of the partitions comprises a generally triangular dividing wall which extends between and connects two adjacent side walls of the prism, and wherein each of the dividing walls extends toward but does not contact the third side wall of the prism.

3. The timing device as claimed in claim 1 wherein the port has a cross-sectional area which is equal to that of the neck, whereby the flowable material will pass from the first chamber to the second chamber and the passageway at substantially twice the rate that it will pass from the second to the first chamber.

4. The timing device as claimed in claim 1 wherein the flowable material comprises ballotini.

* * * * *